US005836476A

United States Patent [19]

Ampofo

[11] Patent Number: 5,836,476

[45] Date of Patent: Nov. 17, 1998

[54] MOTORIZED NEWSPAPER DISPENSING SYSTEM

[76] Inventor: Emmanuel Ampofo, P.O. Box 874, Boston, Mass. 02123-0874

[21] Appl. No.: 744,940

[22] Filed: Nov. 6, 1996

[51] Int. Cl.[6] ..... G07F 11/00

[52] U.S. Cl. ..... 221/131; 221/131; 221/155; 221/218; 221/198; 221/258; 221/284; 221/281; 221/250

[58] Field of Search ..... 221/130, 131, 221/155, 217, 218, 253, 282, 284, 199, 258, 277, 250, 281, 193

[56] References Cited

U.S. PATENT DOCUMENTS

| | | | |
|---|---|---|---|
| 187,252 | 2/1877 | Brice | 221/284 |
| 447,343 | 3/1891 | Morse et al. | 271/131 |
| 1,573,037 | 2/1926 | Bradley | 221/131 |
| 2,150,469 | 3/1939 | Tozer et al. | 221/130 |
| 2,263,040 | 11/1941 | Kaltenbach | 221/250 |
| 2,273,814 | 2/1942 | Bartel et al. | 221/130 |
| 4,544,081 | 10/1985 | Voegeli | 221/155 |
| 4,919,250 | 4/1990 | Olson et al. | 221/155 |
| 5,373,963 | 12/1994 | Hsu | 221/258 |
| 5,482,184 | 1/1996 | Chang | 221/218 |

FOREIGN PATENT DOCUMENTS

| | | | |
|---|---|---|---|
| 659 146 | 12/1986 | Switzerland | 221/258 |

*Primary Examiner*—H. Grant Skaggs

[57] ABSTRACT

A new Motorized Newspaper Dispensing System for dispensing of various printed literature within one machine and further minimizing theft by dispensing only one printed literature at a time. The inventive device includes a housing structure strengthened to resist theft which houses various printed literature, a support means elevating the housing structure to a level comfortable for purchasers, a coin receiving means, a dispensing means which mechanically dispenses the selected printed literature, and a sign stand secured to the upper portion of the housing structure providing space for advertising.

7 Claims, 3 Drawing Sheets

MOTORIZED NEWSPAPER DISPENSING SYSTEM

BACKGROUND OF THE INVENTION

1. Field of the Invention

The present invention relates to Vending Devices and more particularly pertains to a new Motorized Newspaper Dispensing System for dispensing of various printed literature within one machine and further minimizing theft by dispensing only one printed literature at a time.

2. Description of the Prior Art

The use of Vending Devices is known in the prior art. More specifically, Vending Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Vending Devices include U.S. Pat. No. 4,875,598; U.S. Pat. No. 5,397,019; U.S. Design Pat. No. 353,841; U.S. Pat. No. 4,651,896; U.S. Design Pat. No. 333,844 and U.S. Pat. No. 5,248,060.

While these devices fulfill their respective, particular objectives and requirements, the aforementioned patents do not disclose a new Motorized Newspaper Dispensing System. The inventive device includes a housing structure strengthened to resist theft which houses various printed literature, a support means elevating the housing structure to a level comfortable for purchasers, a coin receiving means, a dispensing means which mechanically dispenses the selected printed literature, and a sign stand secured to the upper portion of the housing structure providing space for advertising.

In these respects, the Motorized Newspaper Dispensing System according to the present invention substantially departs from the conventional concepts and designs of the prior art, and in so doing provides an apparatus primarily developed for the purpose of dispensing of various printed literature within one machine and further minimizing theft by dispensing only one printed literature at a time.

SUMMARY OF THE INVENTION

In view of the foregoing disadvantages inherent in the known types of Vending Devices now present in the prior art, the present invention provides a new Motorized Newspaper Dispensing System construction wherein the same can be utilized for dispensing of various printed literature within one machine and further minimizing theft by dispensing only one printed literature at a time.

The general purpose of the present invention, which will be described subsequently in greater detail, is to provide a new Motorized Newspaper Dispensing System apparatus and method which has many of the advantages of the Vending Devices mentioned heretofore and many novel features that result in a new Motorized Newspaper Dispensing System which is not anticipated, rendered obvious, suggested, or even implied by any of the prior art Vending Devices, either alone or in any combination thereof.

To attain this, the present invention generally comprises a housing structure strengthened to resist theft which houses various printed literature, a support means elevating the housing structure to a level comfortable for purchasers, a coin receiving means, a dispensing means which mechanically dispenses the selected printed literature, and a sign stand secured to the upper portion of the housing structure providing space for advertising.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Motorized Newspaper Dispensing System apparatus and method which has many of the advantages of the Vending Devices mentioned heretofore and many novel features that result in a new Motorized Newspaper Dispensing System which is not anticipated, rendered obvious, suggested, or even implied by any of the prior art Vending Devices, either alone or in any combination thereof.

It is another object of the present invention to provide a new Motorized Newspaper Dispensing System which may be easily and efficiently manufactured and marketed.

It is a further object of the present invention to provide a new Motorized Newspaper Dispensing System which is of a durable and reliable construction.

An even further object of the present invention is to provide a new Motorized Newspaper Dispensing System which is susceptible of a low cost of manufacture with regard to both materials and labor, and which accordingly is then susceptible of low prices of sale to the consuming public, thereby making such Motorized Newspaper Dispensing System economically available to the buying public.

Still yet another object of the present invention is to provide a new Motorized Newspaper Dispensing System which provides in the apparatuses and methods of the prior art some of the advantages thereof, while simultaneously overcoming some of the disadvantages normally associated therewith.

Still another object of the present invention is to provide a new Motorized Newspaper Dispensing System for dispensing of various printed literature within one machine and further minimizing theft by dispensing only one printed literature at a time.

Yet another object of the present invention is to provide a new Motorized Newspaper Dispensing System which includes a housing structure strengthened to resist theft which houses various printed literature, a support means elevating the housing structure to a level comfortable for purchasers, a coin receiving means, a dispensing means which mechanically dispenses the selected printed literature, and a sign stand secured to the upper portion of the housing structure providing space for advertising.

Still yet another object of the present invention is to provide a new Motorized Newspaper Dispensing System that retains money separately for each of the various printed literature sold from the present invention.

Even still another object of the present invention is to provide a new Motorized Newspaper Dispensing System that provides an efficient utilization of sales space by providing compact compartments for various printed literature.

Still another object of the present invention is to provide a new Motorized Newspaper Dispensing System which eliminates utilizing multiple machines for the sale of various printed literature.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
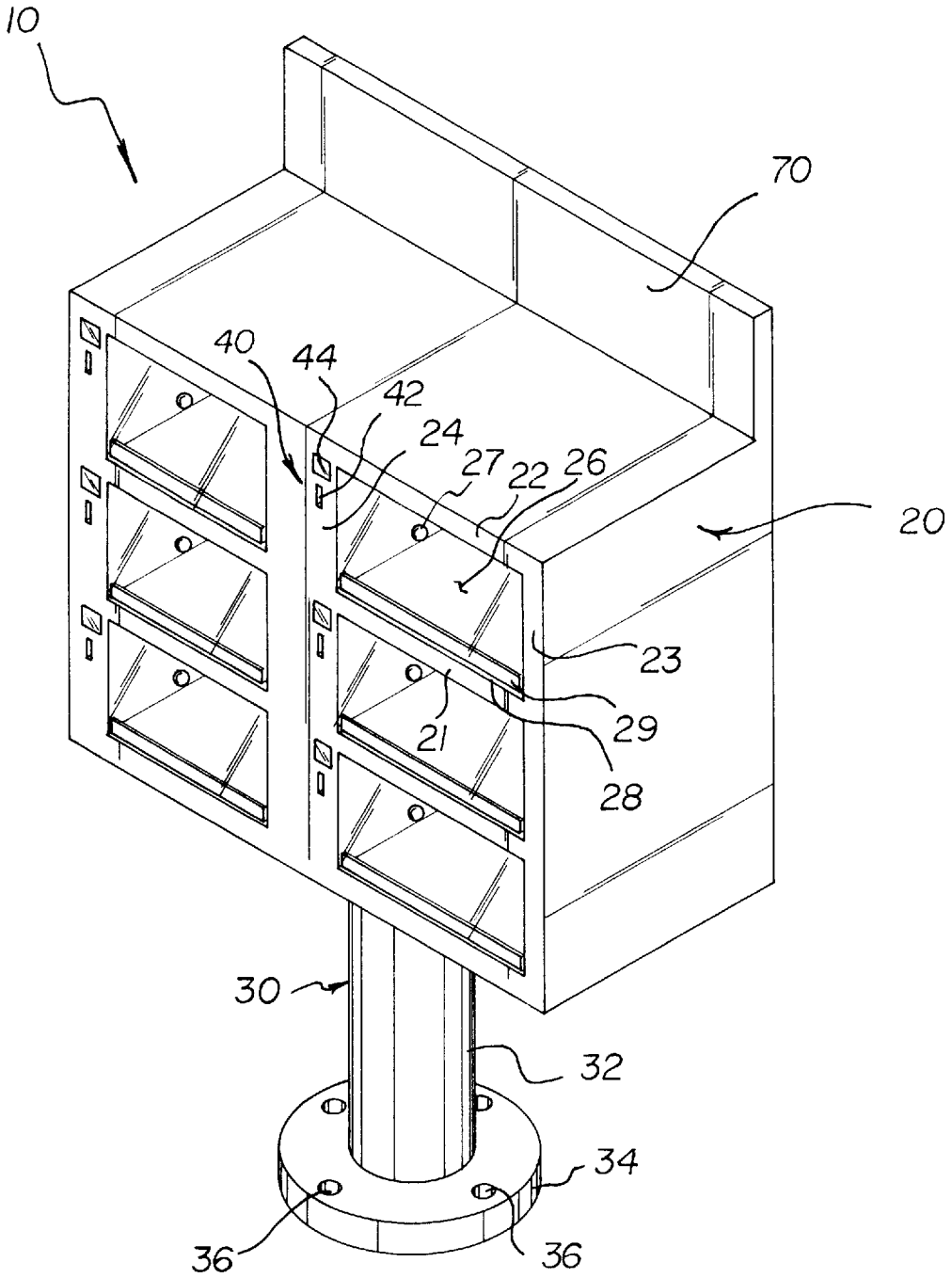
FIG. 1 is a right side perspective view of a new Motorized Newspaper Dispensing System according to the present invention.
Figure 2:
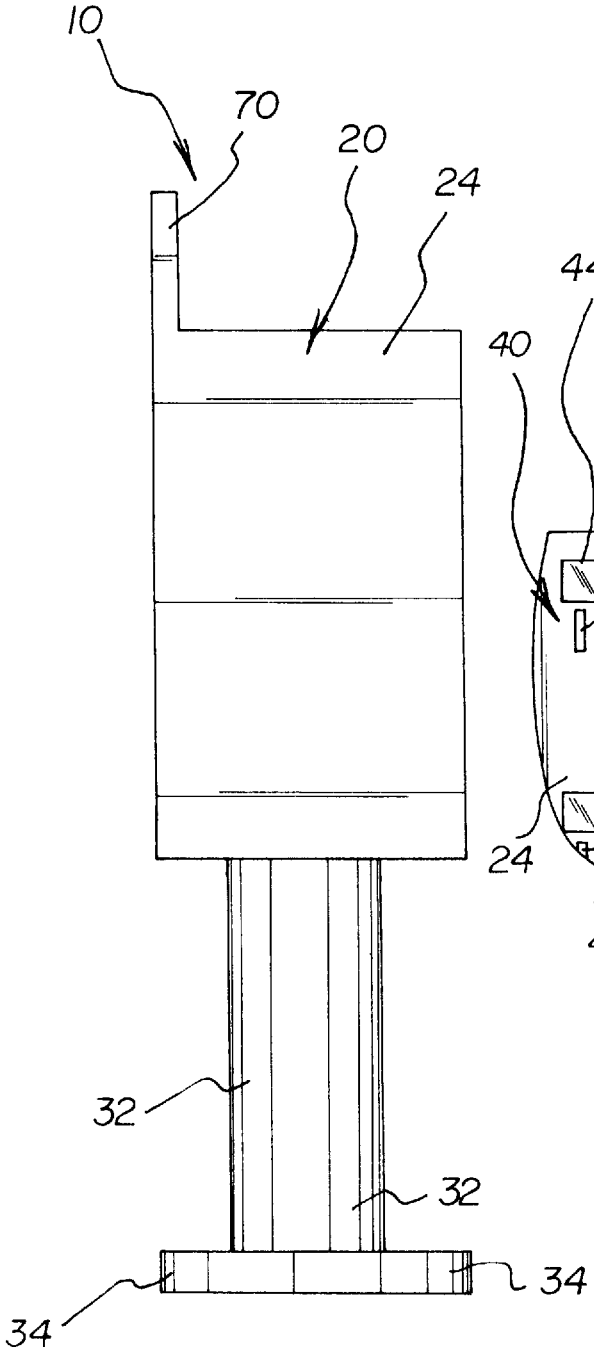
FIG. 2 is a left side view thereof.
Figure 3:
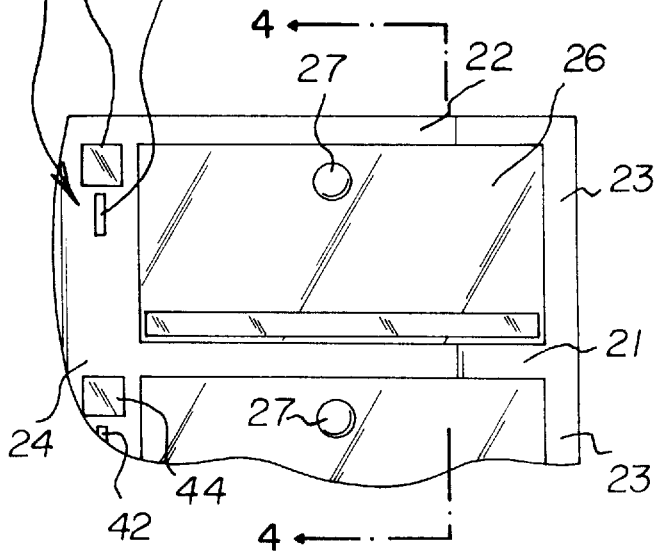
FIG. 3 is a magnified view of the frontal portion of the present invention.

With reference now to the drawings, and in particular to FIGS. 1 through 5 thereof, a new Motorized Newspaper Dispensing System embodying the principles and concepts of the present invention and generally designated by the reference numeral 10 will be described.

More specifically, it will be noted that the Motorized Newspaper Dispensing System 10 comprises a housing structure 20 formed to store printed literature 12, a support means 30 secured to the bottom side of the housing structure 20 elevating the housing structure 20 to a level comfortable for an average height person, a coin receiving means 40 secured to the front left side of the housing structure 20 receiving coins deposited from purchasers, a dispensing means 50 secured within the lower portion of the housing structure 20 substantially horizontal, and a sign stand 70 secured to the rear top portion of the housing structure 20 supporting advertising material.

Figure 4:
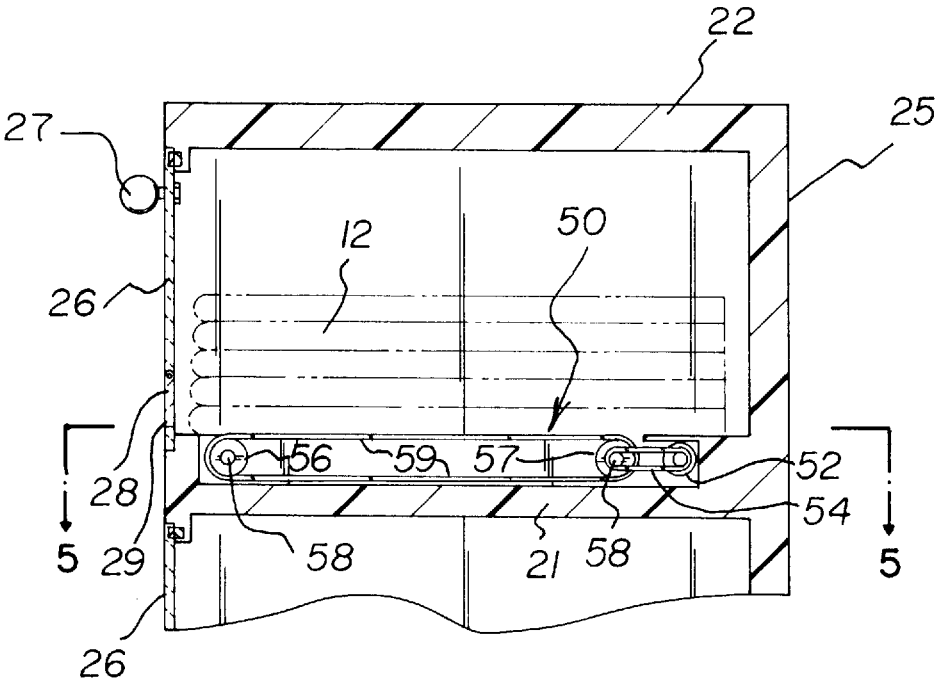
FIG. 4 is a cross sectional view taken along line 4–4 of FIG. 3 disclosing the interior of the housing structure including the dispensing means.
Figure 5:
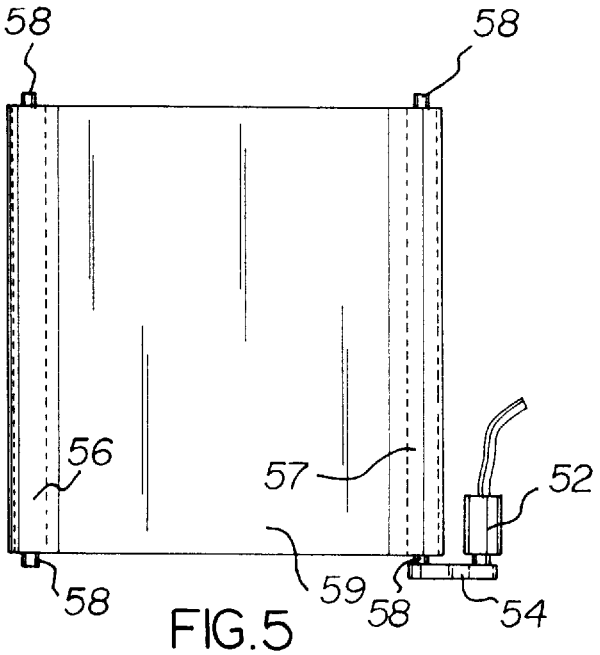
FIG. 5 is a cross sectional view taken along line 5—5 of FIG. 4 disclosing the dispensing means.

As best illustrated in FIGS. 1 through 5, it can be shown that the housing structure 20 includes a bottom member 21 horizontally positioned with respect to ground. A left side member 24 is secured orthogonally to the left edge of the bottom member 21. A right side member 23 is secured orthogonally to the edge of the bottom member 21 opposite of the left side member 24. A top member 22 is secured at one end to the left side member 24 opposite of the bottom member 21 and projecting horizontally to the bottom member 21. The top member 22 is secured to the right side member 23 opposite of the bottom member 21 forming an unnumbered rectangular tube which is sized to store printed literature 12. A rear member 25 encloses the rear end of the unnumbered rectangular tube as best shown in FIG. 4 of the drawings. A transparent refilling door 26 is secured to the end of the unnumbered rectangular tube opposite of the rear member 25. The transparent refilling door 26 includes a dispensing slot 28 in the lower portion allowing the printed literature 12 to project through as disclosed in FIG. 4 of the drawings. A handle 27 is secured to the exterior surface of the transparent refilling door 26. A dispensing door 29 is formed to the shape of the dispensing slot 28 and pivotally attached on an elongated edge to the top edge of the dispensing slot 28. The dispensing door 29 rotatably encloses the dispensing slot 28 while allowing interior printed literature 12 to engage the dispensing door 29 rotating the dispensing door 29 outward away from the rear member 25 allowing dispensing of the printed literature 12. The support means 30 includes a shaft 32 secured orthogonally at one end to the central bottom surface of the bottom member 21. A circular base 34 is secured orthogonally to the end of the shaft 32 opposite of the bottom member 21 providing stability to the present invention as best disclosed in FIG. 1 of the drawings. The circular base 34 includes a plurality of mounting apertures 36 proportionally spaced around the shaft 32. The coin receiving means 40 includes a coin slot 42 receiving conventional coinage and a cost display 44 positioned to the upper exterior portion of the left side member 24. The dispensing means 50 includes a motor 52 mounted to the bottom member 21 where the longitudinal axis of the motor 52 is parallel to the rear member 25 as best disclosed in FIG. 5 of the drawings. A first roller 56 including a roller pin 58 at each end where the roller pin 58*s* rotatably engage the left side member 24 and the right side member 23 positioning the first roller 56 parallel to the rear wall near the motor 52. A second roller 57 includes more roller pins 58 at each end where the roller pins 58 rotatably engage the left side member 24 and the right side member 23 positioning the first roller 56 parallel to the first roller 56. A conveyor belt 59 is rotatably secured around the first roller 56 at one end and rotatably secured around the second roller 57 at the opposite end as best disclosed in FIG. 5 of the drawings. A drive belt 54 is secured to the motor 52 at one end and secured to the roller pin 58 rotatably engaging the right side member 23 of the first roller 56, thereby mechanically connecting the motor 52 and the conveyor belt 59. Preferably, there are at least six juxtaposed housing structures 20 where each includes the coin receiving means 40 and the dispensing means 50. As disclosed in FIG. 1 of the drawings, when there are six housing structures 20, they preferably are stacked in two vertical rows of three housing structures 20 where each includes the coin receiving means 40 and the dispensing means 50.

In use, the purchaser inserts an unnumbered coin into the coin slot 42 next to the desired printed literature 12 within the housing structure 20. The coin receiving means 40 thereafter activates the motor 52 which rotates the conveyor belt 59 which manipulates the lower printed literature 12 by projecting the lower printed literature 12 through the dispensing slot 28. After a preset time, the motor 52 terminates rotation and the user is then able to retrieve the extended printed literature 12 projecting through the dispensing slot 28.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A newspaper dispensing system, comprising:

a housing structure formed to store printed literature;

a support means secured to the bottom side of the housing structure elevating the housing structure to a level comfortable for an average height person;

a coin receiving means secured to the front left side of the housing structure receiving coins deposited from purchasers;

a dispensing means secured within the lower portion of the housing structure substantially horizontal;

a sign stand secured to the rear top portion of the housing structure supporting advertising material; and wherein the housing structure includes:

a bottom member horizontally positioned with respect to ground;

a left side member secured orthogonally to the left edge of the bottom member;

a right side member secured orthogonally to the edge of the bottom member opposite of the left side member;

a top member secured at one end to the left side member opposite of the bottom member and projecting horizontally to the bottom member where the top member is secured to the right side member opposite of the bottom member forming a rectangular tube which is sized to store printed literature;

a rear member enclosing the rear end of the rectangular tube;

a transparent refilling door secured to the end of the rectangular tube opposite of the rear member, where the transparent refilling door includes a dispensing slot in the lower portion allowing the printed literature to project through;

a handle secured to the exterior surface of the transparent refilling door; and a dispensing door formed to the shape of the dispensing slot and pivotally attached on an elongated edge to the top edge of the dispensing slot rotatably enclosing the dispensing slot while allowing interior printed literature to engage the dispensing door rotating the dispensing door outward away from the rear member allowing dispensing of the printed literature.

2. The newspaper dispensing system of claim 1, wherein the support means includes:

a shaft secured orthogonally at one end to the central bottom surface of the bottom member;

a circular base secured orthogonally to the end of the shaft opposite of the bottom member; and the circular base including a plurality of mounting apertures proportionally spaced around the shaft.

3. The newspaper dispensing system of claim 2, wherein the coin receiving means includes a coin slot receiving conventional coinage and a cost display positioned to the upper exterior portion of the left side member.

4. The newspaper dispensing system of claim 3, wherein the dispensing means includes:

a motor mounted to the bottom member where the longitudinal axis of the motor is parallel to the rear member;

a first roller including a roller pin at each end where the roller pins rotatably engage the left side member and the right side member positioning the first roller parallel to the rear wall near the motor;

a second roller including more roller pins at each end where the roller pins rotatably engage the left side member and the right side member positioning the first roller parallel to the first roller;

a conveyor belt rotatably secured around the first roller at one end and rotatably secured around the second roller at the opposite end; and a drive belt secured to the motor at one end and secured to the roller pin rotatably engaging the right side member of the first roller, thereby mechanically connecting the motor and the conveyor belt.

5. The newspaper dispensing system of claim 4, wherein there are at least six juxtaposed housing structures where each includes the coin receiving means and the dispensing means.

6. The newspaper dispensing system of claim 5, wherein there are six housing structures stacked in two vertical rows of three housing structures where each includes the coin receiving means and the dispensing means.

7. A newspaper dispensing system, comprising:

a housing structure having a refilling door, said housing structure being formed to store printed literature therein;

said housing having a coin receiving means for receiving coins deposited from purchasers;

a dispensing means for dispensing printed literature from the interior of said housing;

wherein said refilling door has a dispensing slot, said dispensing slot being for allowing the projection of printed literature therethrough;

a dispensing door for closing said dispensing slot, said dispensing door being pivotally coupled to said refilling door;

wherein said housing structure has a storage cavity being defined by a top member, a bottom member, a left side member, a right side member, and a rear member, said refilling door enclosing said storage cavity;

wherein said refilling door is transparent;

a handle being coupled to said refilling door for aiding opening and closing of said refilling door;

a support means for supporting said housing structure on a surface; and wherein said dispensing means includes:

a first roller;

a second roller being positioned substantially parallel to said first roller;

a conveyor belt being looped about said first roller and said second roller; and a motor operatively connected to said first roller to permit rotation of said first roller by said motor; and wherein said conveyor belt forming a substantially horizontal resting surface for resting printed matter thereon, said resting surface having an area, said area of said resting surface being at least half the area of the surface of an item of printed matter being rested thereon.

* * * * *